US005352555A

United States Patent [19]

Yagi et al.

[11] Patent Number: 5,352,555

[45] Date of Patent: Oct. 4, 1994

[54] ELECTROPHOTOGRAPHIC PHOTORECEPTOR AND ELECTROPHOTOGRAPHIC PROCESS THEREFOR

[75] Inventors: Shigeru Yagi; Tsuyoshi Ohta; Taketoshi Higashi; Masao Watanabe; Kazuo Yano; Masato Ono; Yuzuru Fukuda, all of Kanagawa, Japan

[73] Assignee: Fuji Xerox Co., Ltd., Tokyo, Japan

[21] Appl. No.: 74,495

[22] Filed: Jun. 11, 1993

[30] Foreign Application Priority Data

Jun. 12, 1992 [JP] Japan ..... 4-177776

[51] Int. Cl.[5] ..... G03G 5/14

[52] U.S. Cl. ..... 430/62; 430/66; 430/69

[58] Field of Search ..... 430/60, 62, 63, 64, 430/65

[56] References Cited

U.S. PATENT DOCUMENTS

| | | | |
|---|---|---|---|
| 4,868,078 | 9/1991 | Sakai et al. | 430/65 |
| 4,873,165 | 10/1989 | Kayakida et al. | 430/66 |
| 5,008,170 | 4/1991 | Karakida et al. | 430/66 |

FOREIGN PATENT DOCUMENTS

| | | |
|---|---|---|
| 54-86341 | 7/1979 | Japan . |
| 60-59367 | 4/1985 | Japan . |
| 61-9547 | 1/1986 | Japan . |
| 61-159544 | 7/1986 | Japan . |
| 62-142740 | 6/1987 | Japan . |
| 4-182657 | 6/1992 | Japan . |

*Primary Examiner*—John Goodrow

*Attorney, Agent, or Firm*—Finnegan, Henderson, Farabow, Garrett & Dunner

[57] ABSTRACT

An electorphotographic photoreceptor comprises an electroconductive support at least whose indentation hardness of surface is 100 and over on the Vickers hardness scale; a photoconductive layer comprising amorphous silicon containing at least one of hydrogen and halogen; and a surface layer comprising at least one of an amorphous silicon layer containing at least one of nitrogen, oxygen, and carbon, and an amorphous carbon layer containing at least one of not exceeding 50 atm. % of hydrogen and halogen. This photoreceptor is long-lived and causing no image defects that would otherwise develop in connection with the support, and it can be applied to an energy-saving, low-cost and highly reliable electrophotographic process and apparatus.

16 Claims, 2 Drawing Sheets

ELECTROPHOTOGRAPHIC PHOTORECEPTOR AND ELECTROPHOTOGRAPHIC PROCESS THEREFOR

BACKGROUND OF THE INVENTION

This invention relates to a long-lived electrophotographic photoreceptor and an electrophotographic process therefor.

Previously, selenium has been used extensively in electrophotographic photoreceptors. In recent years, the use of organic photoreceptors and amorphous silicon photoreceptors has been grown increasingly. When electrophotographic photoreceptors are processed by the Carlson method, each of steps as charging, exposure, development, transfer, erasure and cleaning is a factor to cause deteriorations of the photoreceptors. Especially, various flaw and wear generated in copying progress are the most significant factor that determines the life of electrophotographic photoreceptors. Therefore, it has been proposed that a protective layer is disposed on the surface of an electrophotographic photoreceptor or that the photoconductive layer is made from amorphous silicon having high hardness [cf., for example, Japanese Patent Unexamined Application No. Sho. 54-86341].

However, if the previous proposed electrophotographic photoreceptors are installed in copiers or printers, flaws occurs unavoidably during the copying progress on account of sliding contact with the particles of toner, carrier or any foreign matter that develop as a result of paper jams. Especially, an electrophotographic photoreceptor having an object to be a longer life have to endure accidents as mentioned above encountered during the copying progress in order to improve reliability thereof. Examples of flaws occurred by the accident include cracks developed only in the photoconductive layer, damage penetrated into a support, and dents occurred in the photoconductive layer. Since these flaws occur by accident, their development mechanism is not completely clear. However, in many cases, it is postulated that the cause is insufficient strength of either the photoconductive layer or the support, for example, the heretofore used aluminum substrate [cf. Japanese Patent Unexamined Application Nos. Sho. 61-159544, Sho. 61-9547 and Sho. 62-142740].

Another factor considered to determine the life of amorphous silicon base photoreceptors is the development of image defects such as black or white spots occurring on account of film imperfections. It is known that film imperfections develops as convex image defects with sized of 30 μm and more.

Film imperfections are caused by reasons including the deposition of dirt particles before film formation and the sticking of dust particles during film formation and other causes that are equally important are in many causes related to the constituent material of substrates and the method of their treatment, as exemplified by materials defects in the substrate and the projections that left unremoved as a result of finish-working [T. Fukuda, S. Shirai, K. Saitoh and H. Ogawa, Optoelectronics, Vol. 4, p. 273 (1989)].

SUMMARY OF THE INVENTION

The invention has been accomplished under these circumstances and has as an object providing an electrophotographic photoreceptor that is sufficiently improved in its resistance to accidents to provide a longer service life.

Another object of the invention is to provide an electrophotographic photoreceptor that permits development by the magnetic brush method to form an electrophotographic image of high quality without background staining (fogging).

A further object of the invention is to provide an electrophotographic process by which image having satisfactory fixability can be formed with high reliability.

Namely, one object of the invention is to prevent flaw developments caused the low strength of supports and photoconductive layers, their constituent materials and the method of finishing the support so as to supply the long-life electrophtographic photoreceptor having an amorphous silicon base light-sensitive layer. Another object of the invention is to supply the electrophotographic process applied to operate an energy-saving, low-cost and highly reliable image outputting apparatus.

An electorphotographic photoreceptor of the invention comprises an electroconductive support at least whose indentation hardness of surface is 100 and over on the Vickers hardness scale, a photoconductive layer comprising amorphous silicon containing at least one of hydrogen and halogen, and a surface layer comprising at least one of an amorphous silicon layer containing at least one of nitrogen, oxygen, and carbon, and an amorphous carbon layer containing at least one of not exceeding 50 atm. % of hydrogen and halogen.

An electrophotographic process of the invention comprises the steps of electrifying the surface of an electrophotographic photoreceptor having a photoconductive layer comprising amorphous silicon, exposing said surface to form a latent electrostatic image thereon, developing said latent image with a toner, transferring said toner image onto a sheet, removing toner particles remaining on the surface of photoreceptor after transfer and discharging electric charges that are left on the surface, and fixing the transferred toner image on the sheet, wherein said photoreceptor comprises an electroconductive support at least whose indentation hardness of surface is 100 and over on the Vickers hardness scale, a photoconductive layer comprising amorphous silicon containing at least one of hydrogen and halogen, and a surface layer comprising at least one of an amorphous silicon layer containing at least one of nitrogen, oxygen, and carbon, and an amorphous carbon layer containing at least not exceeding 50 atm. % of hydrogen and halogen.

An electrophotographic apparatus of the invention comprises a photoreceptor drum whose surface having a photoconductive layer which comprises amorphous silicon, charging means for electrifying said surface, means for exposing the surface so that a latent electrostatic image is formed thereon, developing means for developing the latent electrostatic with a toner, transferring means for transferring the formed toner image onto a sheet member, and fixing means for fixing the transferred image on the sheet member, wherein said photoreceptor comprises an electroconductive support at least whose indentation hardness of surface is 100 and over on the Vickers hardness scale, a photoconductive layer comprising amorphous silicon containing at least one of hydrogen and halogen, a surface layer comprising at least one of an amorphous silicon layer containing at least one of nitrogen, oxygen, and carbon, and an amorphous carbon layer containing at least not exceeding 50 atm. % of hydrogen and halogen.

DESCRIPTION OF THE PREFERRED EMBODIMENTS

The invention is described below with reference to the accompanying drawings.

Figure 1:
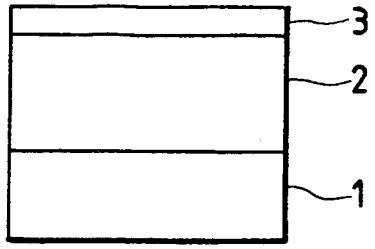
FIG. 1 is a schematic cross-sectional view showing an example of the electrophotographic photoreceptor of the invention.
Figure 2:
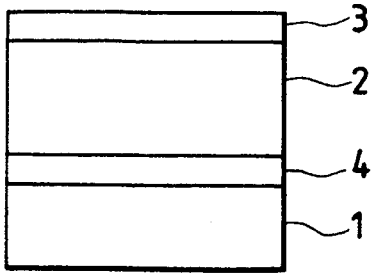
FIG. 2 is a schematic cross-sectional view showing another example of the electrophotographic photoreceptor of the invention.
Figure 3:
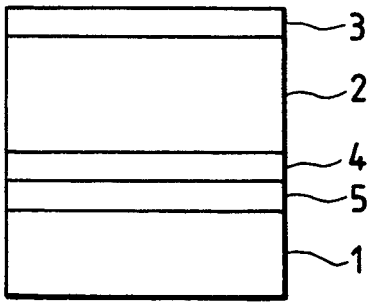
FIG. 3 is a schematic cross-sectional view showing yet another example of the electrophotographic photoreceptor of the invention.
Figure 4:
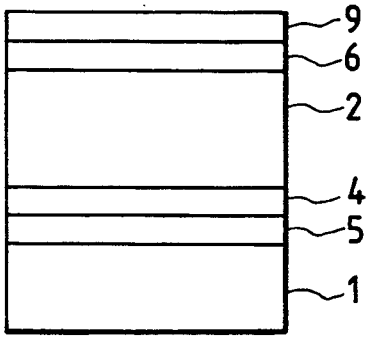
FIG. 4 is a schematic cross-sectional view showing still another example of the electrophotographic photoreceptor of the invention.
Figure 5:
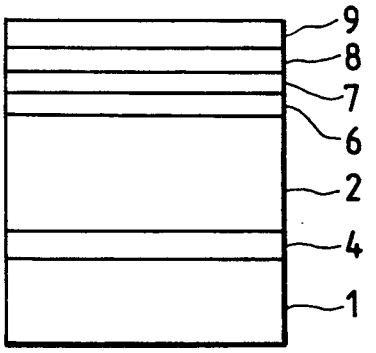
FIG. 5 is a schematic cross-sectional view showing a further example of the electrophotographic photoreceptor of the invention.

FIGS. 1 to 5 are schematic cross-sectional views showing five examples of the electrophotographic photoreceptor of the invention, and which shows the basic layer arrangement that an electroconductive support 1 is overlaid with a photoconductive layer 2 chiefly made of amorphous silicon and a surface layer 3 that are formed in superposition. In FIG. 2, a charge barrier 4 is disposed between the conductive support 1 and the photoconductive layer 2. In FIG. 3, an auxiliary layer 5 is disposed between the conductive support 1 and the charge barrier 4. FIGS. 4 and 5 show the case where the surface layer has an accumulated layer structure consisting of a surface protective layer 9 and one or more intermediate layers; in the case shown in FIG. 4, only one intermediate layer 6 is formed whereas in the case shown in FIG. 5, three intermediate layers 6 to 8 are disposed.

In the invention, the electroconductive support may be formed of Cr-Ni containing steels which are generally referred to as "austenitic stainless steels". Preferred conductive supports are such that at least a conductive layer containing molybdenum, chromium, manganese, tungsten or titanium as a principal component is formed on the surface of the conductive support made from those austenitic stainless steels. Such conductive layer can be formed by plating, sputtering or evaporation.

The conductive support used in the invention may be such that an aluminum substrate is overlaid with a conductive layer chiefly formed of chromium, titanium, tungsten or molybdenum. If desired, a conductive support composed of molybdenum, tungsten or titanium may also be used.

In the invention, it is essential that the supports described above have an indentation hardness in the surface of at least 100 as measured on the Vickers hardness scale. If the Vickers hardness of the support is less than 100, concave flaws or dents may develop in the surface of the photoreceptor for various reasons such as paper jams, entrance of foreign matter, and striking with paper stripping fingers.

The conductive supports used in the invention typically have thickness in the range from 0.5 to 50 mm, preferably from 1 to 20 mm.

The conductive supports used in the invention may have their surface polished. Stated more specifically, buffing, honing or any other suitable polishing techniques may be repeated with the size of abrasive particles being varied from coarse to fine grade until a smooth surface is produced. The surface roughness generally ranges from 2 S to 0.02 S, preferably from 0.5 S to 0.03 S, in terms of $R_S$. The surface of the conductive supports may be preferably specular or it may be matted with fine streaks. However, it is absolutely necessary that taken as a whole, the supports should have a smooth in the absence of any residual projections that would otherwise form on the surface at the boundary between adjacent pitches of cutting with a lathe.

The photoconductive layer and the optionally disposed charge barrier comprise chiefly amorphous silicon as a principal component and they can be formed by any suitable method of such as glow discharge decomposition, sputtering, ion plating or vacuum evaporation. To take glow discharge decomposition as an example, those layers may be produced by the following procedure. First, a feed gas is prepared from the mixture of a primary feed gas containing silicon atoms and an auxiliary feed gas containing the necessary additive elements. If necessary, this gaseous mixture may further contain a carrier gas such as hydrogen or an inert gas. The film forming conditions may be as follows: frequency, 0 to 5 GHz; pressure in the reactor, $10^{-5}$ to 10 Torr (0.001 to 1333.3 Pa); discharge power, 10 to 3000 W; and substrate temperature, 30° to 300° C. The film thickness can be set at appropriate values by adjusting the discharge time. Examples of the primary feed gas containing silicon atoms are silanes, as in particular, $SiH_4$ and/or $Si_2H_6$.

The photoconductive layer is formed principally from amorphous silicon containing hydrogen and/or a halogen. The thickness of the photoconductive layer ranges preferably from 1 to 100 μm. An element of the group III of the periodic table may be incorporated in the photoconductive layer. A typical example of a feed gas containing the element of the group III is diborane ($B_2H_6$). The amount of addition of such element is determined by the charge polarity of the photoreceptor and the spectral sensitivity required of the photoreceptor, and usually, elements of the group III are added in amounts ranging from 0.01 to 1000 ppm. For various purposes such as improving properties of the electrification, reducing dark decay and improving the sensitivity, other elements such as nitrogen, carbon and oxygen may be further added to the amorphous silicon based photoconductive layer. If desired, at least one of Ge and Sn may be contained in the photoconductive layer. In the invention, the photoconductive may be composed of two kind of layers which are a charge generation layer and a charge transport layer.

The charge barrier is composed of amorphous silicon to which an element of the group III or V is added. Whether one should use an element of the group III or V as an additive is determined by the charge polarity of the photoreceptor. In case of forming the charge barrier, diborane ($B_2H_6$) is typically used as a feed gas containing an element of the group III, whereas ($PH_3$, $NH_3$) is typically used as a feed gas containing an element gas of the group V. In addition to the element of the group III or V, at least one of nitrogen, oxygen, carbon and a halogen may be further incorporated in the charge barrier.

If desired, an auxiliary layer such as an adhesive layer may be disposed between the charge barrier and the conductive support. Exemplary auxiliary layers may be formed from a-SiNx, a-SiCy and a-SiOz that are amorphous silicon species containing at least one element such as nitrogen, carbon or oxygen; x, y and z are preferably within the following ranges: $0.01<x<0.3$; $0.01<y<0.5$; and $0.01<z<0.5$. The thickness of auxiliary layers is preferably in the range from 0.01 to 3 μm.

The surface layer is composed of either amorphous silicon containing at least one of nitrogen, oxygen and carbon or amorphous carbon containing no more than 50 atm. % of hydrogen and/or a halogen or both types of amorphous material in superposed layers. When a drop of pure water is placed on the surface layer, it preferably forms a contact angle of at least 60°, more preferably at least 80°. The surface layer preferably has a surface hardness of at least 500 kg/mm$^2$, more preferably 1000 kg/mm$^2$, on the Vickers hardness scale.

If the surface layer is made of amorphous silicon containing at least either one of nitrogen, oxygen and carbon, it can be formed by a suitable method such as plasma-assisted CVD, evaporation or ion plating, examples of the appropriate amorphous silicon that can be used include SiOx, SiNx and SiCx. More specifically, silanes, in particular, $SiH_4$ and/or $Si_2H_6$, may be used as primary feed gases containing silicon atoms. The following may be used as feed gases for incorporating nitrogen, oxygen or carbon: nitrogen-containing feed gases such as $N_2$ gas alone, as well as gases of hydrogenated nitrogen compounds such as $NH_3$, $N_2H_4$ and $NH_3$; carbon-containing feed gases such as hydrocarbons (e.g., methane, ethane, propane and acetylene) and halogenated hydrocarbons (e.g., $CF_4$ and $C_2F_6$); and oxygen-containing feed gases such as $O_2$, $N_2O$, CO and $CO_2$.

If the surface layer may be composed of amorphous carbon containing hydrogen and/or a halogen, a large amount of hydrogen or halogen contained in the surface layer increases the content of chained —$CH_2$—, —$CF_2$— or —$CH_3$ bonds as to eventually impair the hardness of the surface layer. Therefore, the content of hydrogen or halogen in the surface layer must be less than 50 atm. %. Also in this case, the surface layer can be formed by plasma-assisted CVD, evaporation or ion plating, with plasma-assisted CVD being particularly preferred.

The feed materials be able to used in the invention are described below. The feed materials for carbon which is a principal component of the surface layer are as follows: aliphatic hydrocarbons such as paraffinic hydrocarbons represented by the general formula $C_nH_{2n+2}$ which are exemplified by methane, ethane, propane, butane and pentane, olefinic hydrocarbons represented by the general formula $C_nH_{2n}$ which are exemplified by ethylene, propylene, butylene and pentene, and acetylenic hydrocarbons represented by the general formula $C_nH_{2n-2}$ which are exemplified by acetylene, allylene and butyne; alicyclic hydrocarbons such as cyclopropane, cyclobutane, cyclopentane, cyclohexane, cycloheptane, cyclobutene, cyclopentane and cyclohexene; aromatic hydrocarbons such as benzene, toluene, xylene, naphthalene and anthracene; and substituted forms of the hydrocarbons listed above. These hydrocarbon compounds may have branched structure or they may be substituted with a halogen, as in the case of halogenated hydrocarbons that are exemplified by carbon tetrachloride, chloroform, carbon tetrafluoride, trifluoromethane, chlorotrifluoromethane, dichlorodifluoromethane, bromotrifluoromethane, perfluoroethane and perfluoropropane.

The carbon feeds listed above may be gaseous, solid or liquid at ordinary temperatures; solid or liquid carbon feeds should be used after vaporization.

If the surface layer composed of amorphous carbon containing hydrogen and/or a halogen is formed by plasma-assisted CVD, at least one gaseous feed as selected from among the materials listed above may be introduced into a vessel at reduced pressure so as to produce glow discharge. In this case, other gaseous materials different from those gaseous feeds may also be used with the latter. For example, a carrier gas such as hydrogen, helium, argon or neon may also be used. When performing glow discharge decomposition by plasma-assisted CVD, either DC or AC discharge may be employed and the film forming conditions that can be typically adopted are as follows: frequency, 0.1 to 2.45 GHz (preferably 5 to 20 MHz); the degree of vacuum during discharge, 0.1 to 5 Torr (13.3 to 667 Pa); the support heating temperature, 30° to 400° C. The thickness of the surface protective layer can be set at an appropriate value by adjusting the discharge time and it ranges generally from 0.01 to 10 μm, preferably from 0.1 to 5 μm.

In the invention, the surface layer may be formed of the two layers in superposition, wherein one is the layer composed of amorphous silicon containing either one of nitrogen, oxygen and carbon, and the other is the layer composed of amorphous carbon containing hydrogen and/or a halogen. This alternative case is illustrated in FIGS. 4 and 5 and, as shown, the surface layer has a accumulated structure consisting of a surface protective layer 9 and one or more intermediate layers 6 to 8.

If a plurality of intermediate layers are formed as shown in FIG. 5, each intermediate layers has preferably the following features: the first intermediate layer 6 has a concentration of carbon, oxygen or nitrogen atoms that ranges from 0.1 to 1.0 in terms of atomic ratio to silicon atoms with the thickness of the layer being in the range from 0.01 to 0.1 μm; the second intermediate layer 7 has a concentration of carbon, oxygen or nitrogen atoms that ranges from 0.1 to 1.0 in terms of atomic ratio to silicon atoms with the thickness of the layer being in the range from 0.05 to 1 μm; and the third intermediate layer 8 has a higher concentration of carbon, oxygen or nitrogen atoms than that of the second intermediate layer 7 (i.e., in the range from 0.5 to 1.3 in terms of atomic ratio to silicon atoms) with the thickness of the layer being in the range from 0.01 to 0.1 μm.

Figure 6:
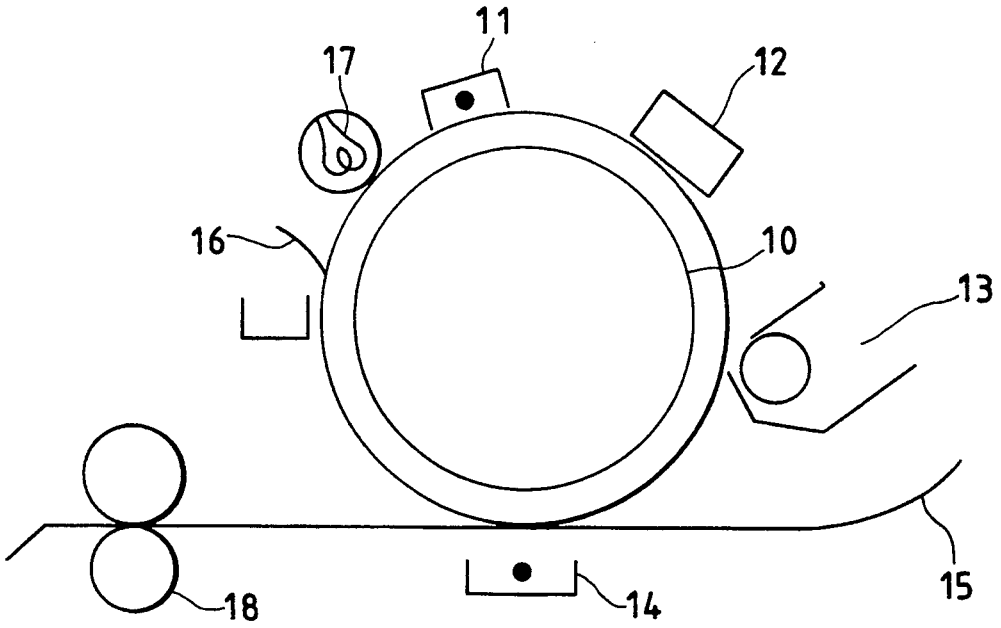
FIG. 6 is a schematic diagram showing part of the layout of an electrophotographic apparatus that can be used to implement the process of the invention.

In the next place, the electrophotographic process according to the second aspect of the invention is described below. FIG. 6 is a diagram showing schematically the layout of the essential part of an electrophotographic apparatus for implementing the process of the invention which is to be performed in the following manner. First, the surface of a photoreceptor around a photoreceptor drum 10 having the above-described photoconductive layer which is chiefly made of amorphous silicon is electrified with a charging device 11; thereafter, exposure is performed under light from the image of a document passing through optics or from an image inputting device 12 such as a laser or LED, whereby latent electrostatic image is formed. The formed latent electrostatic image is rendered visible with a toner in a developing device 13 so that it is converted to a toner image. In this case, development may be performed by the magnetic brush method.

The toner image thus formed is transferred onto a receiving sheet 15 either by application of pressure or with an electrostatic transfer device 14. The toner particles remaining on the surface of the photoreceptor after transfer are removed by a cleaner mechanism 16 using a blade and the electric charges that are left in a small amount on the photoreceptor's surface are eliminated by erase light device 17. The blade in the cleaner mechanism 16 may be formed of various metals, among which aluminum, iron, nickel, stainless steel, tungsten, molybdenum and titanium are particularly preferred. The transferred toner image is fixed with a fixing device 18.

Figure 7:
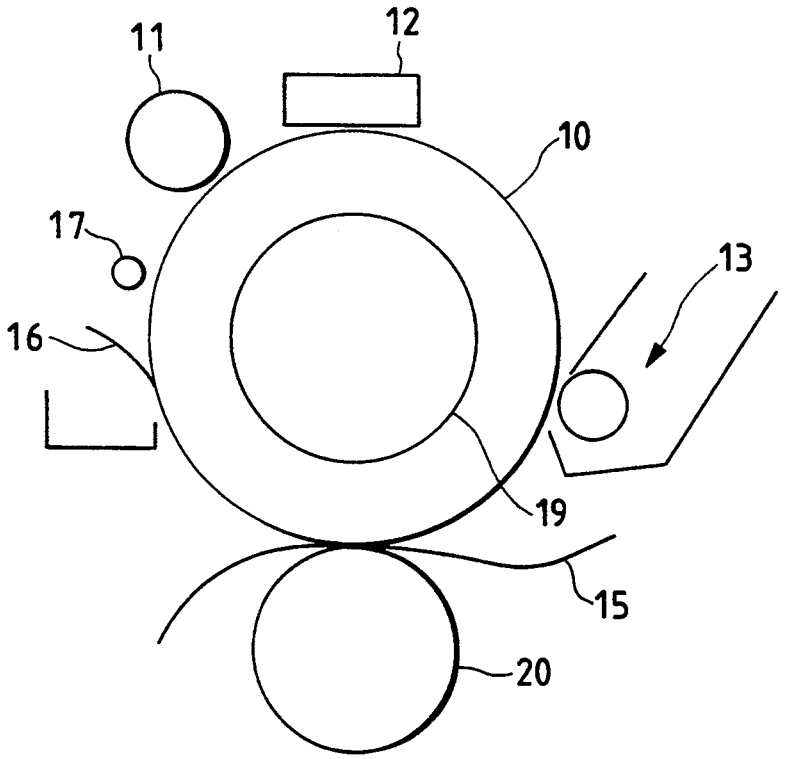
FIG. 7 is a schematic diagram showing part of the layout of another electrophotographic a apparatus that can be used to implement the process of the invention.

When performing image transfer by application of pressure, the pressure being applied may be enhanced to insure that both transfer and fixing of the toner image are accomplished at the same time. FIG. 7 shows the essential part of an electrophotographic apparatus that may be used in this alternative case. As shown, a heating device 19 is installed within the photoreceptor drum 10 and by pressing a fixing roll 20 into contact with the drum 10, the toner image is transferred and fixed simultaneously on the receiving sheet 15. Those components in FIG. 7 which are the same as those shown in FIG. 6 are identified by like numerals.

The following examples and comparative examples are disposed for the purpose of further illustrating the invention but are in no way to be taken as limiting.

EXAMPLE 1

The support used in this example was a cylindrical substrate made of an austenitic stainless steel (SUS 304) that has an indentation hardness of 200 in the surface on the Vickers hardness scale and has a thickness of 1 mm after polishing to a surface roughness $R_S$ of 0.2 μm. An amorphous silicon photoreceptor was formed by depositing the following layers successively on the periphery of the cylinder: a charge barrier, a photoconductive layer, and a surface SiNx layer that was composed of three sublayers an which had a total thickness of 0.5 μm. The procedure of the photoreceptor preparation was as follows.

After thorough evacuation, the reactor was supplied with a mixture of silane, hydrogen and diborane gases, and glow discharge decomposition was performed, whereby a charge barrier was formed in a thickness of 4 μm. The film forming conditions were as follows.

Flow rate of 100% silane gas: 180 $cm^3$/min
Flow rate of 100% hydrogen gas: 90 $cm^3$/min
Flow rate of 200 ppm $H_2$ diluted diborane gas: 90 $cm^3$/min
Pressure in the reactor: 1.0 Torr
Discharge power: 200 W
Discharge time: 60 min
Discharge frequency: 13.56 MHz
Support temperature: 250° C.

(In the subsequent steps of photoreceptor preparation, the discharge frequency and the support temperature were fixed at 13.56 MHz and 250° C., respectively.)

After the formation of the charge barrier, the reactor was evacuated thoroughly and then supplied with a mixture of silane, hydrogen and diborane gases, and glow discharge decomposition was performed, whereby a photoconductive layer was formed in a thickness of 20 μm on the charge barrier. The film forming conditions were as follows.

Flow rate of 100% silane gas: 180 $cm^3$/min
Flow rate of 100% hydrogen gas: 162 $cm^3$/min
Flow rate of 20 ppm $H_2$ diluted diborane gas: 18 $cm^3$/min
Pressure in the reactor: 1.0 Torr
Discharge power: 300 W
Discharge time: 200 min After the formation of the photoconductive layer, the reactor was evacuated thoroughly and then supplied with a mixture of silane, hydrogen and ammonia gases, and glow discharge decomposition was performed, whereby the first intermediate layer was formed in a thickness of 0.15 μm on the photoconductive layer. The film forming conditions were as follows.

Flow rate of 100% silane gas: 20 $cm^3$/min
Flow rate of 100% hydrogen gas: 180 $cm^3$/min
Flow rate of 100% ammonia gas: 30 $cm^3$/min
Pressure in the reactor: 0.5 Torr
Discharge power: 50 W
Discharge time: 30 min After the formation of the first intermediate layer, the reactor was evacuated thoroughly and then supplied with a mixture of silane, hydrogen and ammonia gases, and glow discharge decomposition was performed, whereby the second intermediate layer was formed in a thickness of 0.25 μm on the first intermediate layer. The film forming conditions were as follows.

Flow rate of 100% silane gas: 24 $cm^3$/min
Flow rate of 100% hydrogen gas: 180 $cm^3$/min
Flow rate of 100% ammonia gas: 36 $cm^3$/min
Pressure in the reactor: 0.5 Torr
Discharge power: 50 W
Discharge time: 40 min After the formation of the second intermediate layer, the reactor was evacuated thoroughly and then supplied with a mixture of silane, hydrogen and ammonia gases, and glow discharge decomposition was performed, whereby a surface protective layer was formed in a thickness of 0.1 μm on the second intermediate layer. The film forming conditions were as follows.

Flow rate of 100% silane gas: 15 $cm^3$/min
Flow rate of 100% hydrogen gas: 180 $cm^3$/min
Flow rate of 100% ammonia gas: 43 $cm^3$/min
Pressure in the reactor: 0.5 Torr
Discharge power: 50 W
Discharge time: 20 min The electrophotographic photoreceptor prepared by the procedure described above was installed in a printer of the type shown in FIG. 6 and an image forming operation was performed using a polyurethane resin blade in the cleaning device. Development was conducted by the magnetic brush method using a one-component developer. The image formed was sharp and contained no discernible fog.

As it was heated at 45° C., the photoreceptor was subjected to an image forming test and it was found that as many as 1,000,000 prints could be produced without any flaws in the photoreceptor and black or white spots on the image. However, a film of the toner's external additive was deposited on the surface of the photoreceptor to produce unevenness in the density of fine lines.

EXAMPLE 2

An electrophotographic photoreceptor of the same type as prepared in Example 1 was subjected to the same procedure of image forming test, except that the polyurethane resin blade in the cleaning unit of the printer was replaced by a steel blade, which was held in intimate contact with the surface of the photoreceptor throughout the test. As many as 1,000,000 prints could be produced without toner fogging or any defects in the image. The photoreceptor's surface was entirely free from the sign of toner deposition, nor was observed any unevenness in image density. However, a few slight flaws developed on the photoreceptor's surface.

EXAMPLE 3

An electrophotographic photoreceptor was prepared an in Example 1, except that it had a surface protective layer with a Vickers hardness of 2500 that was composed of hydrogen-containing amorphous carbon. The surface protective layer was formed under the following conditions.

Flow rate of 100% $C_2H_6$ gas: 50 $cm^3$/min
Pressure in the reactor: 0.5 Torr
Discharge power: 500 W
Discharge time: 10 min
Discharge frequency: 13.56 MHz
Support temperature: 250° C.
Bias on the electrodes: 200 V The electrophotographic photoreceptor thus prepared was subjected to an image forming test as in Example 1. As many as 1,000,000 prints could be produced without toner fogging or any defects in the image. The photoreceptor's surface was entirely free from the sign of toner deposition, nor was observed any flows on it.

Comparative Example 1

An electrophotographic photoreceptor was prepared as in Example 1 except that a cylindrical substrate of Al-Mg alloy having a Vickers hardness of 40, a thickness of 4 mm and a surface roughness ($R_S$) of 0.05 μm was used as the support. This electrophotographic photoreceptor was subjected to an image forming test on the same printer as used in Example 1. After 550,000 prints, a few short black streaks developed on the image. In addition, a film of the toner's external additive was adhered on the photoreceptor's surface to produce unevenness in the density of fine lines. After 1,000,000 prints had been produced, the photoreceptor was examined and small concaves were found in areas corresponding to black streaks. An examination under a microscope revealed that concaves had developed not only in the support but also in the light-sensitive layer, whereby a potential drop occurred causing those concaves to appear as black streaks.

EXAMPLE 4

An electrophotographic photoreceptor was prepared as in Example 1 except that a cylindrical substrate of austenitic stainless steel (SUS 403) with a thickness of 4 mm that had a hard chromium layer formed in a thickness of 100 μm on the surface to provide a Vickers hardness of 800 and which had been polished to a surface roughness ($R_S$) of 0.03 μm. This electrophotographic photoreceptor was subjected to an image forming test on a printer of the type shown in FIG. 7. The developer was a toner in capsules having a diameter of 15 μm that were prepared by the following procedure.

| | |
|---|---|
| Core | |
| Laurly methacrylate polymer (LMA: Mw = $1 \times 10^5$; product of Sanyo Chemical Industries, Ltd.) | 40 parts |
| Magnetic power (EPT-100: product of Toda Kogyo Corp.) | 60 parts |
| Shell | |
| Polyurea resin (interfacial polymer of polymethylene polyphenyl isocyanate and diethylenetriamine) | |

Polymethylene polyphenyl isocyanate (product of The Dow Chemical Company) was added to part of the core and mixture was emulsified to produce granules. Thereafter, an aqueous solution of diethylenetriamine was added and capsule particles were prepared by interfacial polymerization. The capsule particles thus prepared were spray-dried. The ingredients listed below were further added to the dried capsule particles and all components were mixed together to render the capsule electrically conductive.

| | |
|---|---|
| Carbon black (Valcan XC72: product of Cabot Corp.) | 2 wt % |
| Zinc stearate | 0.5 wt % |

To form image, the photoreceptor was processed in the usual manner for charging, exposure and development. Thereafter, image transfer and fixing were conducted simultaneously in the following manner. That is, a transfer roll made of polyvinyl acetal was pressed against the cylindrical photoreceptor at a pressure of 200 kg/$cm^2$, with a sheet of transfer paper being inserted between the two members to effect image transfer and fixing at the same time. The fixation of the image was comparable to that achieved by thermal fixing and there were no residual toner particles on the photoreceptor's surface; the transfer yield was 99.5%. After 1,000,000 prints had been produced, neither flaws nor dents were found on the surface of the photoreceptor. The toner image could be transferred and fixed effectively to produce uniform density over the entire image on A4 paper.

Comparative Example 2

An electrophotographic photoreceptor was prepared as in Example 4, except that an aluminum cylindrical substrate having a thickness of 20 mm was used as the support. This photoreceptor was subjected to an image forming test as in Example 4. Paper jams or the transport of more than one sheets of copy paper at a time occurred during the production of 50,000 to 100,000 prints, causing dents to develop on the photoreceptor's surface.

Having the features described herein-above, the electrophotographic photoreceptor of the invention is protected against the development of flaws and film imperfections that would otherwise occur on account of various factors such as the low strength of the support and the photoconductive layer, the constituent materials thereof, and the method of finishing the support. Hence, this photoreceptor insures that copy images of high quality can be formed over a vary long period. Furthermore, the electrophotographic process using this photoreceptor can be applied to operate an energy-saving, low-cost and highly reliable image outputting apparatus.

What is claimed is:

1. An electrophotographic photoreceptor comprising:

an electroconductive support at least whose indentation hardness of surface is 100 and over on the Vickers hardness scale;

a photoconductive layer comprising amorphous silicon containing at least one of hydrogen and halogen; and a surface layer comprising at least one of an amorphous silicon layer containing at least one of nitrogen, oxygen, and carbon, and an amorphous carbon layer containing at least one of not exceeding 50 atm. % of hydrogen and halogen.

2. An electrophotographic photoreceptor according to claim 1 wherein said electroconductive support comprises austenitic stainless steels.

3. An electrophotographic photoreceptor according to claim 1 wherein said electroconductive support has an electrically conductive layer comprising at least one selected from the group consisting of molybdenum, chromium, manganese, tungsten and titanium.

4. An electrophotographic photoreceptor according to claim 1 wherein said electroconductive support having an electroconductive layer which is formed of one of chromium, titanium, tungsten and molybdenum on an aluminum substrate.

5. An electrophotographic photoreceptor according claim 1 wherein the surface of said electroconductive support is polished.

6. An electrophotographic photoreceptor according to claim 2 wherein the surface of said electroconductive support is polished.

7. An electrophotographic photoreceptor according to claim 3 wherein the surface of said electroconductive support is polished.

8. An electrophotographic photoreceptor according to claim 4 wherein the surface of said electroconductive support is polished.

9. An electrophotographic photoreceptor according to claim 1 wherein a charge barrier is disposed between said electroconductive support and said photoconductive layer, said charge barrier comprising amorphous silicon containing one of an element of the group III and V of the periodic table.

10. An electrophotographic photoreceptor according to claim 9 wherein said amorphous silicon further comprising at least one of nitrogen, oxygen and carbon.

11. An electrophotographic process comprising the steps of:

electrifying the surface of an electrophotographic photoreceptor;

exposing said surface to form a latent electrostatic image thereon;

developing said latent image with a toner;

transferring said toner image onto a sheet;

removing toner particles remaining on the surface of photoreceptor after transfer and discharging electric charges that are left on the surface; and fixing the transferred toner image on the sheet;

wherein said photoreceptor comprises an electroconductive support at least whose indentation hardness of surface is 100 and over on the Vickers hardness scale;

a photoconductive layer comprising amorphous silicon containing at least one of hydrogen and halogen; and a surface layer comprising at least one of an amorphous silicon layer containing at least one of nitrogen, oxygen, and carbon, and an amorphous carbon layer containing at least not exceeding 50 atm. % of hydrogen and halogen.

12. An electrophotographic process according to claim 11 wherein the formed latent electrostatic image is developed with a toner by the magnetic brush method.

13. An electrophotographic process according to claim 12 wherein the residual toner particles is removed with a metal blade after transferring the formed toner image.

14. An electrophotographic process according to claim 11 wherein a sheet member is placed over the formed toner image, and the sheet member is applied pressure so that said toner image is transferred and fixed simultaneously.

15. An electrophotographic apparatus comprising:

a photoreceptor drum whose surface includes a photoconductive layer comprising amorphous silicon;

charging means for electrifying said surface;

means for exposing the surface so that a latent electrostatic image is formed thereon;

developing means for developing the latent electrostatic with a toner;

transferring means for transferring the formed toner image onto a sheet member; and fixing means for fixing the transferred image on the sheet member;

wherein said photoreceptor comprises an electroconductive support at least whose indentation hardness of surface is 100 and over on the Vickers hardness scale;

a photoconductive layer comprising amorphous silicon containing at least one of hydrogen and halogen; and a surface layer comprising at least one of an amorphous silicon layer containing at least one of nitrogen, oxygen, and carbon, and an amorphous carbon layer containing at least not exceeding 50 atm. % of hydrogen and halogen.

16. An electrophotographic apparatus according to claim 15 wherein said electrophotographic apparatus further comprises means for moving toner particles remaining on the surface of the photoreceptor and means for discharging electric charges left on the surface of said photoreceptor.

* * * * *

UNITED STATES PATENT AND TRADEMARK OFFICE

CERTIFICATE OF CORRECTION

PATENT NO. : 5,352,555
DATED : October 04, 1994
INVENTOR(S) : Shigeru YAGI et al.

It is certified that error appears in the above-indentified patent and that said Letters Patent is hereby corrected as shown below:

On title page, Abstract, line 1 change "electorphotographic" to --electrophotographic--; and line 11 change "causing" to --causes--.

Claim 5, column 11, line 32 before "claim" insert --to--.

Claim 13, column 12, line 22 change "is" to --are--.

Signed and Sealed this
Twenty-fifth Day of April, 1995

*Attest:*

*Attesting Officer*

BRUCE LEHMAN

*Commissioner of Patents and Trademarks*